US011291276B1

(12) United States Patent
Chung

(10) Patent No.: US 11,291,276 B1
(45) Date of Patent: Apr. 5, 2022

(54) CLOSED END ZIPPER WITH COMBINED BOTTOM STOP

(71) Applicant: Roger C. Y. Chung, New Taipei (TW)

(72) Inventor: Roger C. Y. Chung, New Taipei (TW)

( * ) Notice: Subject to any disclaimer, the term of this patent is extended or adjusted under 35 U.S.C. 154(b) by 0 days.

(21) Appl. No.: 17/147,452

(22) Filed: Jan. 12, 2021

(30) Foreign Application Priority Data

Nov. 9, 2020 (TW) ..... 109138983
Nov. 9, 2020 (TW) ..... 109214742

(51) Int. Cl.
*A44B 19/30* (2006.01)

(52) U.S. Cl.
CPC ..... *A44B 19/30* (2013.01)

(58) Field of Classification Search
CPC ..... A44B 19/30; A44B 19/38; A44B 19/388
See application file for complete search history.

(56) References Cited

U.S. PATENT DOCUMENTS 2,146,691 A * 2/1939 Sundback ..... A44B 19/38 24/433
4,536,923 A * 8/1985 Murakami ..... A44B 19/38 24/433
5,007,145 A * 4/1991 Kim ..... A44B 19/38 24/433

* cited by examiner

*Primary Examiner* — Robert Sandy
(74) *Attorney, Agent, or Firm* — Pai Patent & Trademark Law Firm; Chao-Chang David Pai

(57) ABSTRACT

A closed end zipper includes a bottom stop at the end of one zipper tape, and a pin at the end of the other zipper tape. The bottom stop has a pin hole and a first detent portion in the pin hole. The pin has a second detent portion formed on the front surface and/or one lateral surface thereof corresponding to the first detent portion. When used to manufacture clothing, the two separate zipper tapes can be sewn on the fabric separately through the template, and then the pin of the other zipper tape is inserted into the pin hole of the bottom stop, so that the second detent portion and the first detent portion snap together. Using this structure, the closed end nylon zipper or resin zipper are suitable for the automated template sewing process to achieve a simple and stable assembly without separation.

20 Claims, 12 Drawing Sheets

CLOSED END ZIPPER WITH COMBINED BOTTOM STOP

BACKGROUND OF THE INVENTION

(a) Field of the Invention

The present invention relates to closed end zipper technology and more particularly to a closed end zipper with combined bottom stop that can separate two zipper tapes so as to be sewn on the left and right sides of clothing, and then merge the bottom stop pieces of the two zipper tapes to become inseparable after the sewing is completed.

(b) Description of the Prior Art

Today's clothing production process has developed to automated production. In the past, many processing steps that required skilled labor have gradually been implemented with automated equipment such as robots. One of them is to use templates with automatic sewing machines to form a new automated production method. The processing step of sewing a zipper in the fabric is an example. Because the design of the zipper template is separated on both sides, when the template machine is used to sew a closed-end zipper (that is, the zipper whose ends of the two zipper tapes cannot be separated) to the fabric, the ends of the two zipper tapes must be separated first. However, the bottom stop of the conventional closed-end zipper has fixed the ends of the two sides of the zipper together, and it is no longer possible to separate the ends of the two zipper tapes.

In response to the above-mentioned technology of automatically sewing zipper on the fabric, a special closed-end zipper whose bottom stop can be separated left and right has been developed on the market. As shown in FIG. 12, a bottom stop 502 is combined at the end of the cloth tape 501 of each of the two zipper tapes 50, and the inner side of each bottom stop 502 is provided with a pair of hooks 503.

Therefore, when sewing the zipper on the fabric, the left and right zipper tapes 50 can be sewn on the fabric separately to speed up the production and sewing. After the sewing is completed, the bottom stops 502 of the two zipper tapes 50 can be connected to each other through the hooks 503.

However, the above-mentioned left and right separated closed-end zipper can only be used in the conventional plastic chain tooth zipper, and cannot be used in the nylon zipper composed of traditional nylon monofilament heated and wound on the center line. Because there is no more reliable combination structure, the problem of separation of the two zipper tape ends of the above-mentioned bottom stop combination structure may occur at any time. Therefore, how to implement nylon zipper and resin zipper as a closed-end zipper with left and right zipper tapes, which can be separated by the above-mentioned automated equipment for sewing, and then closed at the ends after the sewing is completed, with a simple combination method to achieve a firm and stable structure is the subject of the present invention.

SUMMARY OF THE INVENTION

The present invention has been accomplished under the circumstances in view. It is the main object of the present invention to provide a closed end zipper with combined bottom stop having the plug connection structure of the bottom stop and pin at the end of the two zipper tapes, which can be separated to be sewn by automatic sewing equipment, and then combined together at the ends after the sewing is completed. The combination method is simple and the structure is firm and not easy to separate.

To achieve this and other objects of the present invention, a closed end zipper comprises two zipper tapes and a zipper slider. Each zipper tape comprises a cloth tape, and a row of teeth arranged on an inner side of said cloth tape. The zipper slider is used to link the teeth of the two zipper tapes with each other, or to separate the teeth of the two zipper tapes from each other. The cloth tape of one zipper tape is provided with a bottom stop at an end of the respective row of teeth. The cloth tape of the other zipper tape is provided with a pin at a corresponding end of the respective row of teeth. The bottom stop has one half thereof forming a fixing portion fixedly fastened to the associated cloth tape, and the other half thereof forming a protruding block portion protruding from an inner side of the associated cloth tape. The protruding block portion comprises a pin hole recessed from a top side thereof, and a first detent portion formed in the pin hole. The first detent portion comprises a recess and a blocking surface formed in a hole wall of the pin hole. The pin, comprising a second detent portion corresponding to the first detent portion, is used to insert into the pin hole of the bottom stop. The second detent portion is used to engage with the first detent portion when the pin is inserted into the pin hole, so that the recess receives the second detent portion, the blocking surface is abutted against a top surface of the second detent portion, and the pin is prohibited from being separated from the bottom stop after the pin is inserted into said pin hole.

In an alternate form of the present invention, the first detent portion of the bottom stop is implemented as a transverse detent hole extending from the front or back surface of the bottom stop to the pin hole. When the pin is inserted into the pin hole, the second detent portion is engaged with the first detent portion, so that the pin is prohibited from being separated from the bottom stop.

Preferably, the first detent portion is a recess and a blocking surface formed in a hole wall of the pin hole. The recess is adapted for accommodating the second detent portion. The blocking surface is adapted for abutting against a top surface of the second detent portion.

Preferably, the second detent portion is a triangular bump protruding from a middle part of the pin.

Preferably, the second detent portion is an oblique protrusion protruding from a middle part of the pin.

Preferably, the second detent portion is formed on a front surface of the pin, and the first detent portion is formed on a front hole wall of the pin hole.

Preferably, the second detent portion is formed on one lateral surface of the pin, and the first detent portion is formed on one lateral hole wall of the pin hole.

Preferably, the second detent portion is formed on a front surface and one lateral surface of the pin, and the first detent portion is formed on a front hole wall and one lateral hole wall of the pin hole.

Preferably, the pin hole is a rectangular hole, and the pin is a rectangular strip.

Preferably, the protruding block portion further comprises a slot cut through a lateral surface of the pin hole for accommodating the cloth tape to which the pin belongs.

Preferably, the slot extends from the upper end of the bottom stop to the lower end of the bottom stop for the passing of the cloth tape to which the pin belongs.

Preferably, the cloth tape to which the pin belongs comprises a cutout extending toward the outer side and located adjacent to a terminal end of the pin.

DETAILED DESCRIPTION OF THE PREFERRED EMBODIMENTS

Figure 1:
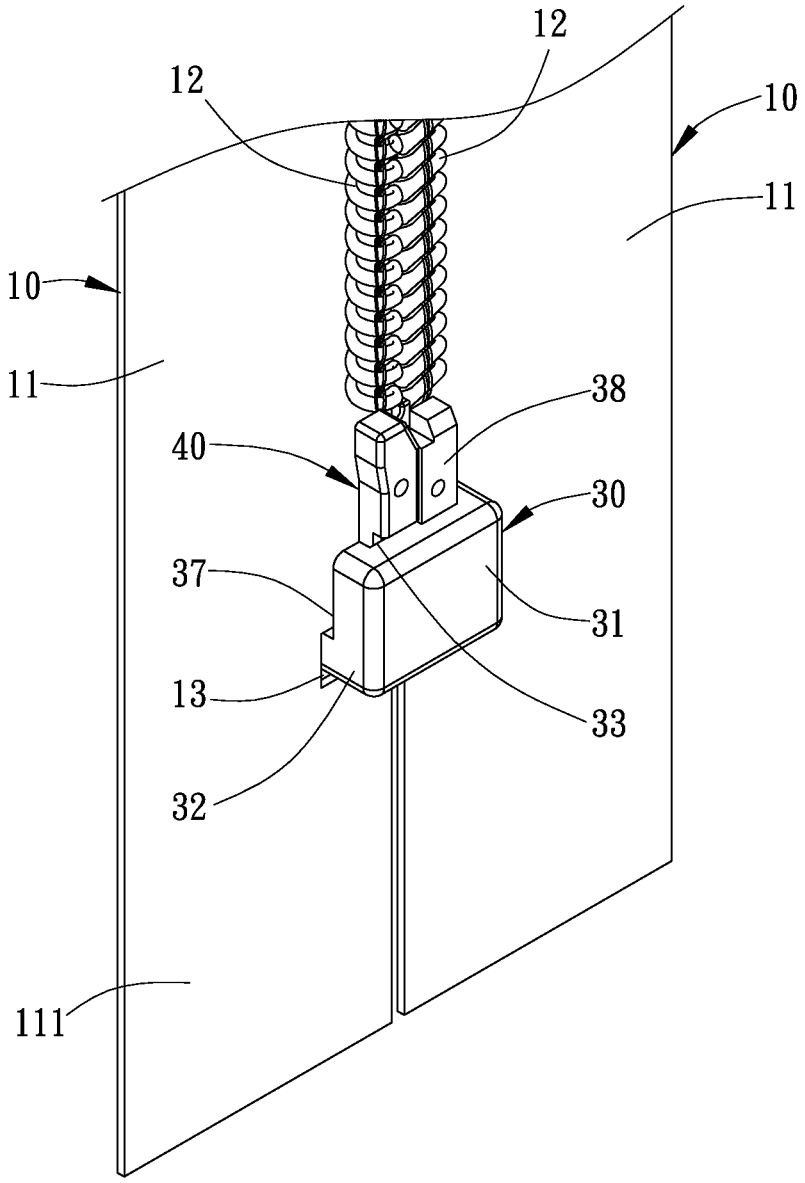
FIG. 1 is a schematic top elevational view of a closed end zipper with combined bottom stop in a combined state in accordance with a first embodiment of the present invention.
Figure 2:
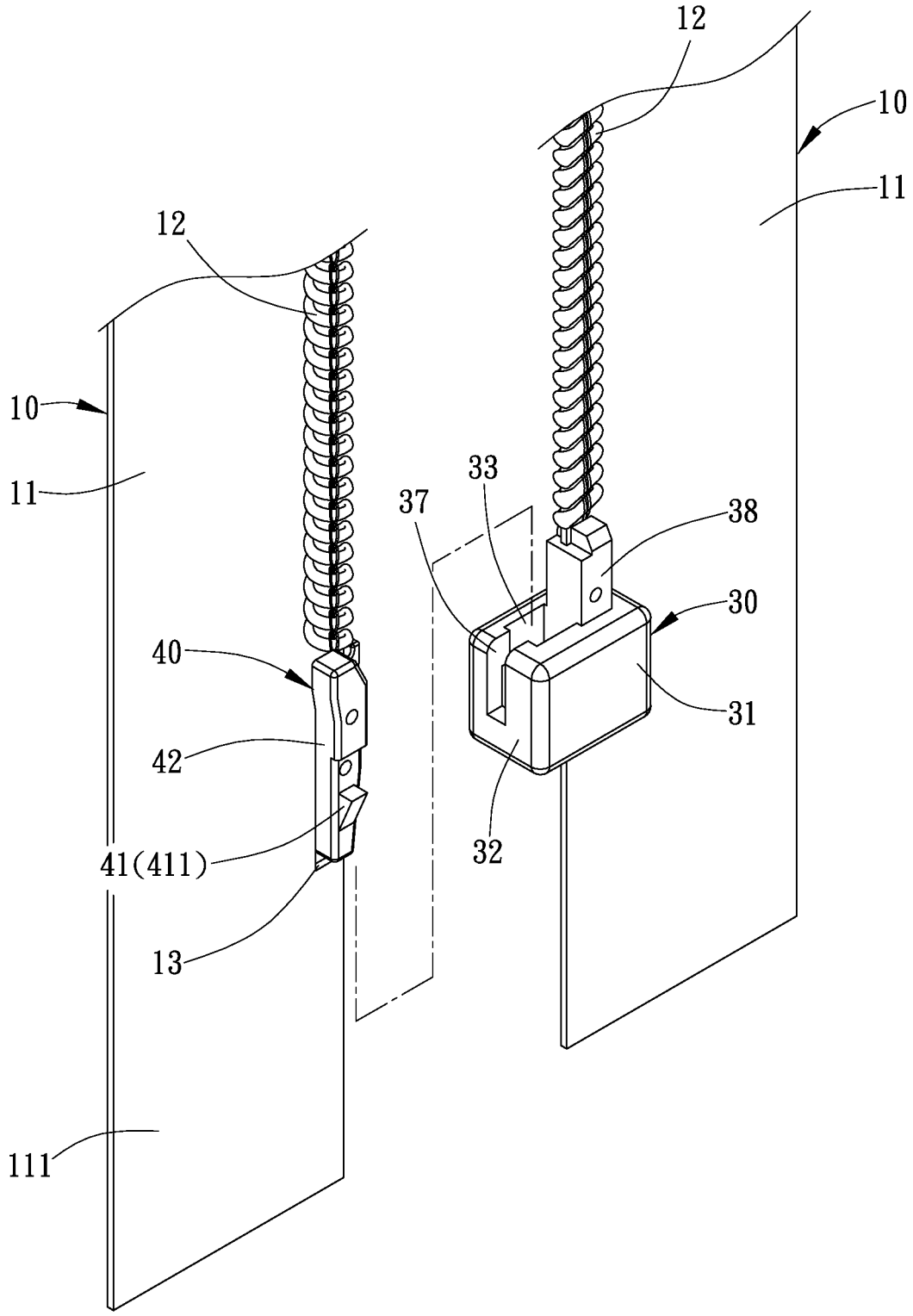
FIG. 2 is a schematic exploded view of the closed end zipper with combined bottom stop of the first embodiment of the present invention.
Figure 3:
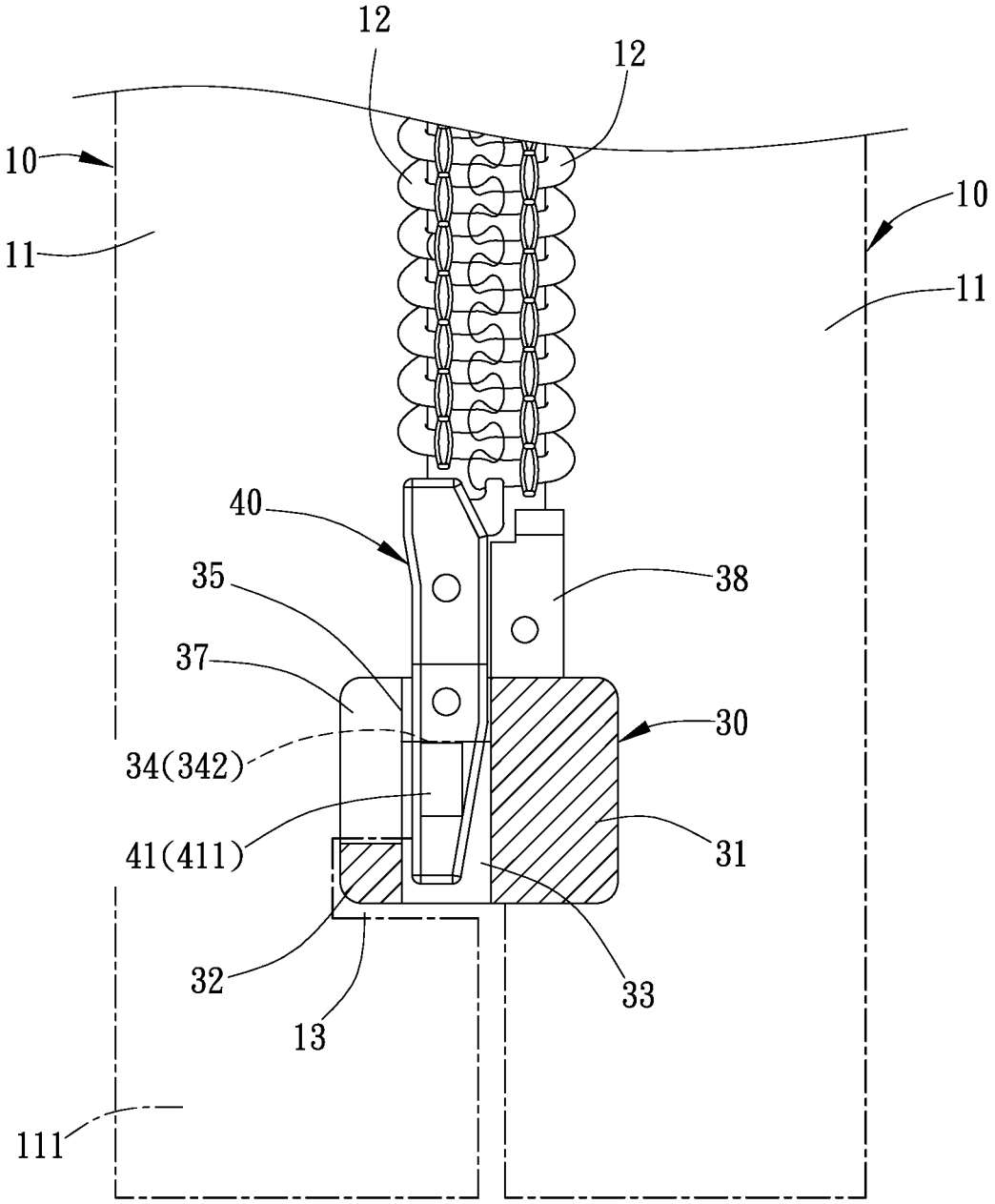
FIG. 3 is a sectional view of the closed end zipper with combined bottom stop in the combined state in accordance with the first embodiment of the present invention.

FIGS. 1, 2 and 3 show a closed end zipper with combined bottom stop in accordance with a first embodiment of the present invention is shown. As illustrated, the close end zipper comprises two zipper tapes 10 and a zipper slider (not shown). Each zipper tape 10 comprises a cloth tape 11 for sewing on the edge of the fabric or article using the zipper, and a row of teeth 12 arranged on the inner side of the cloth tape 11. The teeth 12 can be nylon teeth formed by heating and continuously winding a nylon monofilament around a center line, or resin teeth formed by injection molding on the inner side of cloth tape 11. The zipper slider is used to link the teeth 12 of the two zipper tapes 10 with each other or to separate the teeth 12 of the two zipper tapes 10 from each other. The new improved feature of the present invention is that the cloth tape 11 of one of the two zipper tapes 10 is combined with a bottom stop 30 at the end of the teeth 12, and the cloth tape 11 of the other zipper tape 10 is combined with a pin 40 at the end of the teeth 12. When the cloth tapes 11 of the two zipper tapes 10 are sewn on the fabric or article using the zipper, the pin 40 of one zipper tape 10 is combined with the bottom stop 30 of the other zipper tape 10, so that the pin 40 and the bottom stop 30 cannot be separated, and then the closed end zipper is in a closed state.

Figure 4:
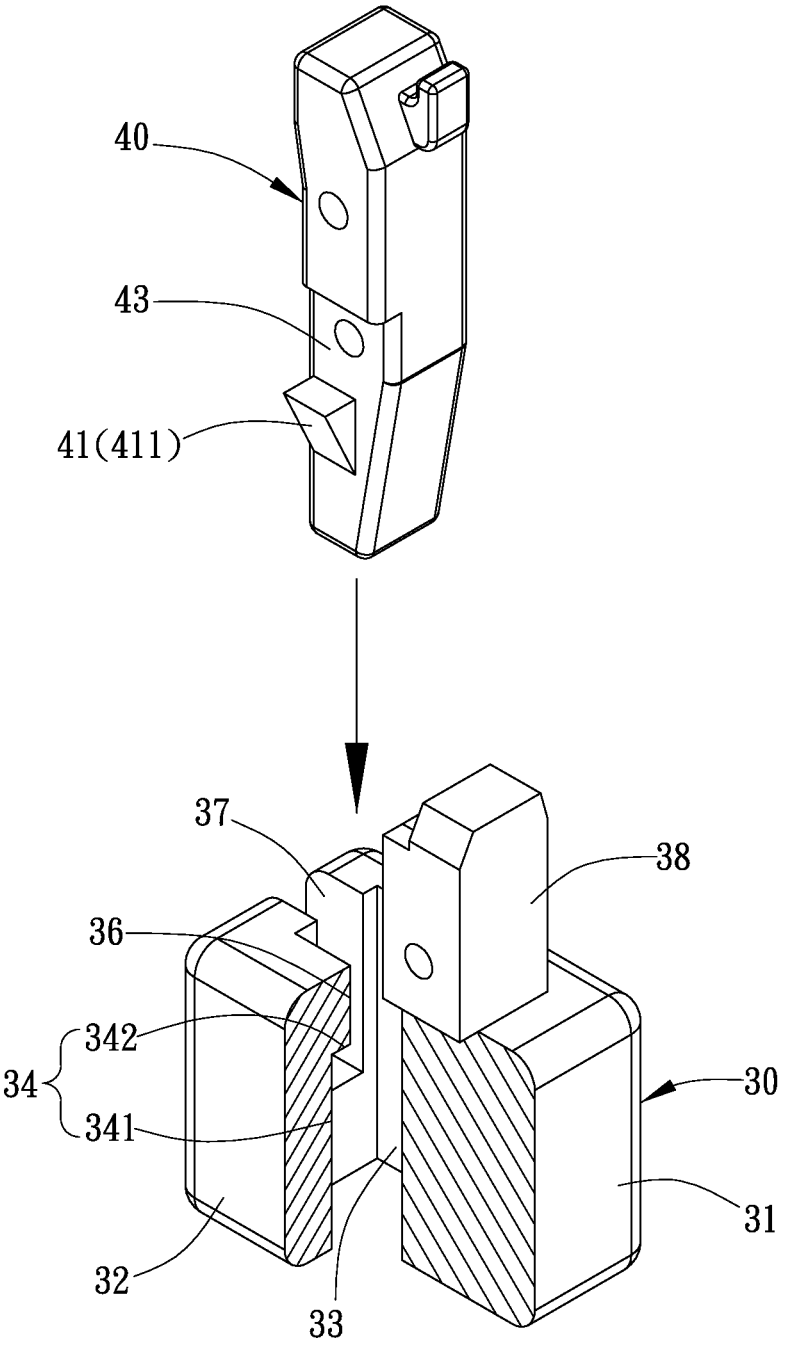
FIG. 4 is a sectional exploded view of a part of the closed end zipper with combined bottom stop in accordance with the first embodiment of the present invention.

Referring to FIG. 4 and FIG. 3 again, the bottom stop 30 is preferably a rectangular block formed by plastic injection molding on the cloth tape 11, one half of which is a fixing portion 31 inseparably fixed to the cloth tape 11, and the other half is protruding block portion 32 protruding from the cloth tape 11. A pin hole 33 is recessed from the upper end to the lower end of the protruding block portion 32. The pin hole 33 may be a recessed hole or a through hole that penetrates to the lower end of the bottom stop 30. More specifically, the pin hole 33 can be implemented as a rectangular hole, and in particular, one side wall of the pin hole 33 is provided with a first detent portion 34, and the first detent portion 34 is used to clamp the pin 40. A protruding false tip 38 that can be integrally formed on the fixing portion 31 of the bottom stop 30 is used to guide the pin 40 into the pin hole 33.

Referring to FIGS. 3 and 4 again, the pin 40 is preferably a rectangular strip formed by plastic injection molding on the cloth tape 11, and the length and width of the cross section of the pin 40 is slightly smaller than the pin hole 33, so that the pin 40 can be inserted into the pin hole 33 of the bottom stop 30. The side of the pin 40 corresponding to the first detent portion 34 forms a second detent portion 41. The second detent portion 41 can be engaged with the first detent portion 34 when the pin 40 is inserted into the pin hole 33, so that the pin 40 and the bottom stop 30 cannot be separated.

Through the structure of the above-mentioned bottom stop 30 and pin 40, the present invention provides two zipper tapes 10 in a separate state to clothing manufacturers, allowing them to use a template with an automatic sewing machine to sew the cloth tapes 11 on the fabric. After the two zipper tapes 10 have been sewn, the pin 40 is inserted at the end of one zipper tape 10 into the pin hole 33 of the bottom stop 30 of the other to form a complete zipper. In the assembly process, in the case that the pin 40 is implemented into the triangular bump 411 or oblique protrusion 412 and the first detent portion 34 is implemented into the structure of a recess 341 and a block surface 342, the slope of the triangular bump 411 is used to open the pin hole 33 until the triangular bump 411 engages with recess 341, or make the oblique protrusion 412 temporarily shrink until the oblique protrusion 412 can be engaged with the recess 341, so that the second detent portion 41 and the first detent portion 34 are locked together, and the two zipper tapes 10 can no longer be separated from each other. In this way, a closed-end zipper is completed, so the closed end zipper is suitable for automatic sewing equipment.

Referring to FIG. 4 again, in the above-mentioned first preferred embodiment of the present invention, the second detent portion 41 of the pin 40 is formed on a front surface 43 of the pin 40, specifically a triangular bump 411 protruding from the middle of the pin 40. The first detent portion 34 in the pin hole 33 is formed on a front hole wall 36 in the pin hole 33, and may be a recess 341 formed in the front hole wall 36 of the pin hole 33. The recess 341 is used to form a blocking surface 342 for clamping the triangular bump 411. When the pin 40 is inserted into the pin hole 33 of the bottom stop 30, the triangular bump 411 is engaged in the recess 341, and the block surface 342 is abutted against a top surface of the triangular bump 411, so that the pin 40 cannot be pulled out in the reverse direction, and therefore cannot be separated from the bottom stop 30. The combination of pin 40 and bottom stop 30 is simple, and the structure is firm and not easy to separate.

Figure 5:
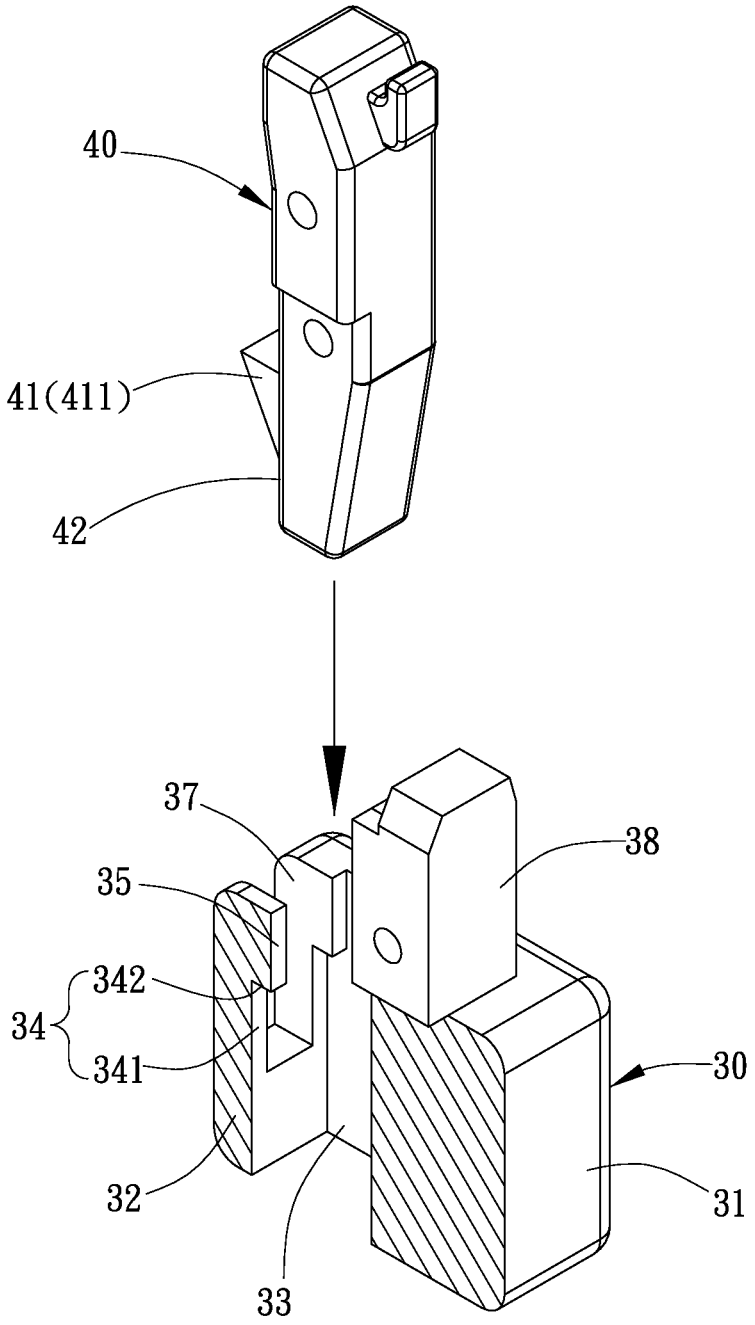
FIG. 5 is a sectional exploded view of a part of a closed end zipper with combined bottom stop in accordance with a second embodiment of the present invention.

Referring to FIG. 5, in a second embodiment of the present invention, the second detent portion 41 is a triangular bump 411 formed on one lateral surface 42 of the pin 40; the first detent portion 34 is formed on one lateral hole wall 35 in the pin hole 33 of the bottom stop 30. The first detent portion 34 can also be implemented as a recess 341 and a blocking surface 342. When the pin 40 is inserted into the pin hole 33 of the bottom stop 30, the triangular bump 411 at the lateral surface 42 is engaged in the recess 341 at the lateral hole wall 35, and the block surface 342 is abutted against a top surface of the triangular bump 411, so that the pin 40 cannot be pulled out in the reverse direction, i.e., the pin 40 and the bottom stop 30 cannot be separated.

Figure 6:
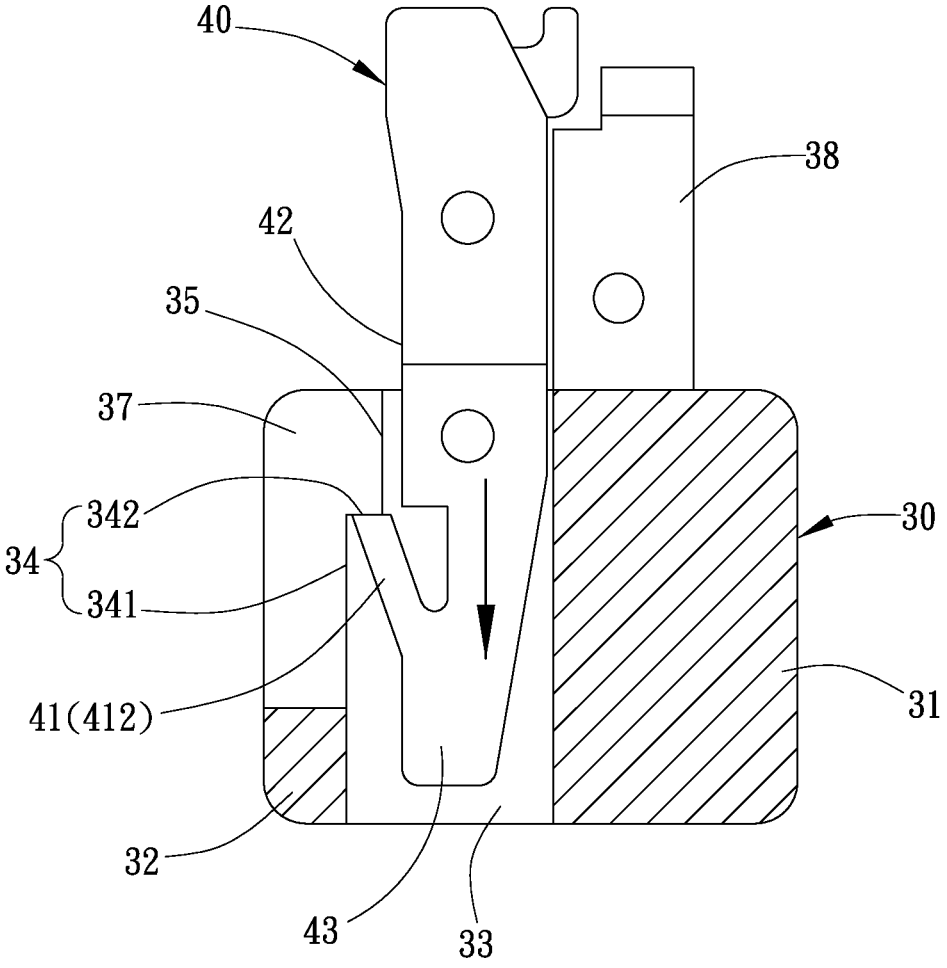
FIG. 6 is a sectional exploded view of a part of a closed end zipper with combined bottom stop in accordance with a third embodiment of the present invention.

Based on the above principle, as shown in FIG. 6, in a third embodiment of the present invention, the second detent portion 41, instead of the above-mentioned triangular bump 411, is an oblique protrusion 412 protruding from the middle of the front surface 43 or the lateral surface 42 of the pin 40. When the pin 40 is inserted into the pin hole 33 of the bottom stop 30, the oblique protrusion 412 is engaged in the recess 341, and the block surface 342 is abutted against a top surface of the oblique protrusion 412, so that the pin 40 cannot be pulled out in the reverse direction, i.e., the pin 40 and the bottom stop 30 cannot be separated. This not only achieves the above effects, but also allows easy insertion of the pin 40 into the bottom stop 30.

Figure 7:
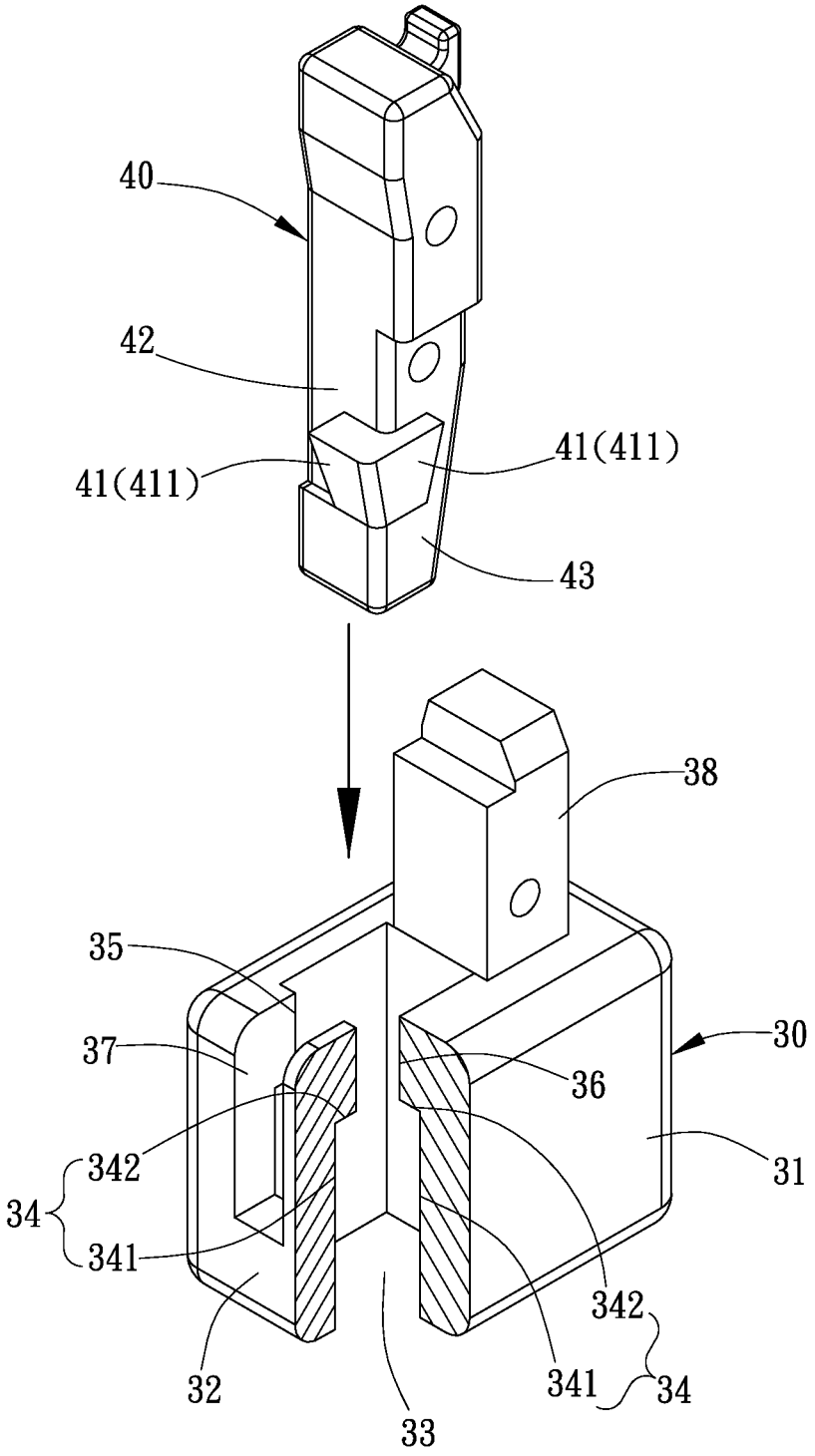
FIG. 7 is an exploded sectional elevational view of a part of a closed end zipper with combined bottom stop in accordance with a fourth embodiment of the present invention.
Figure 8:
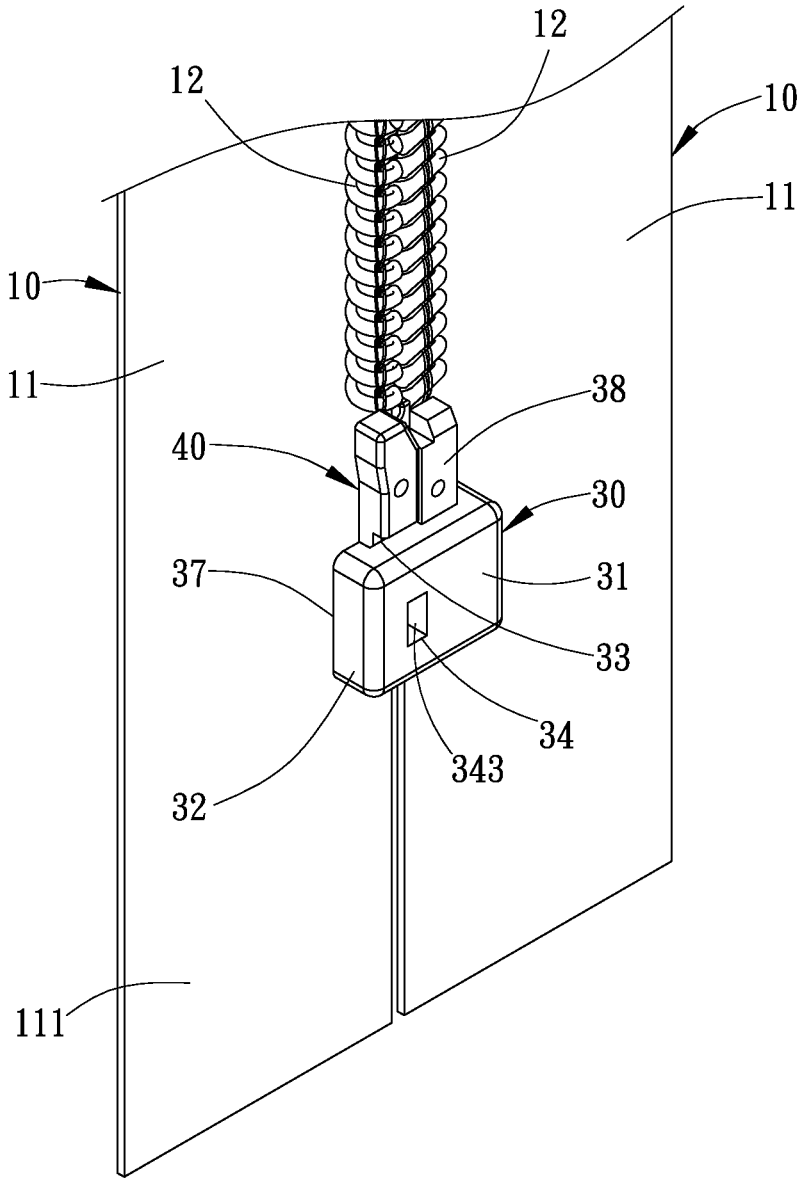
FIG. 8 is a schematic assembly view of a closed end zipper with combined bottom stop in accordance with a fifth embodiment of the present invention.
Figure 9:
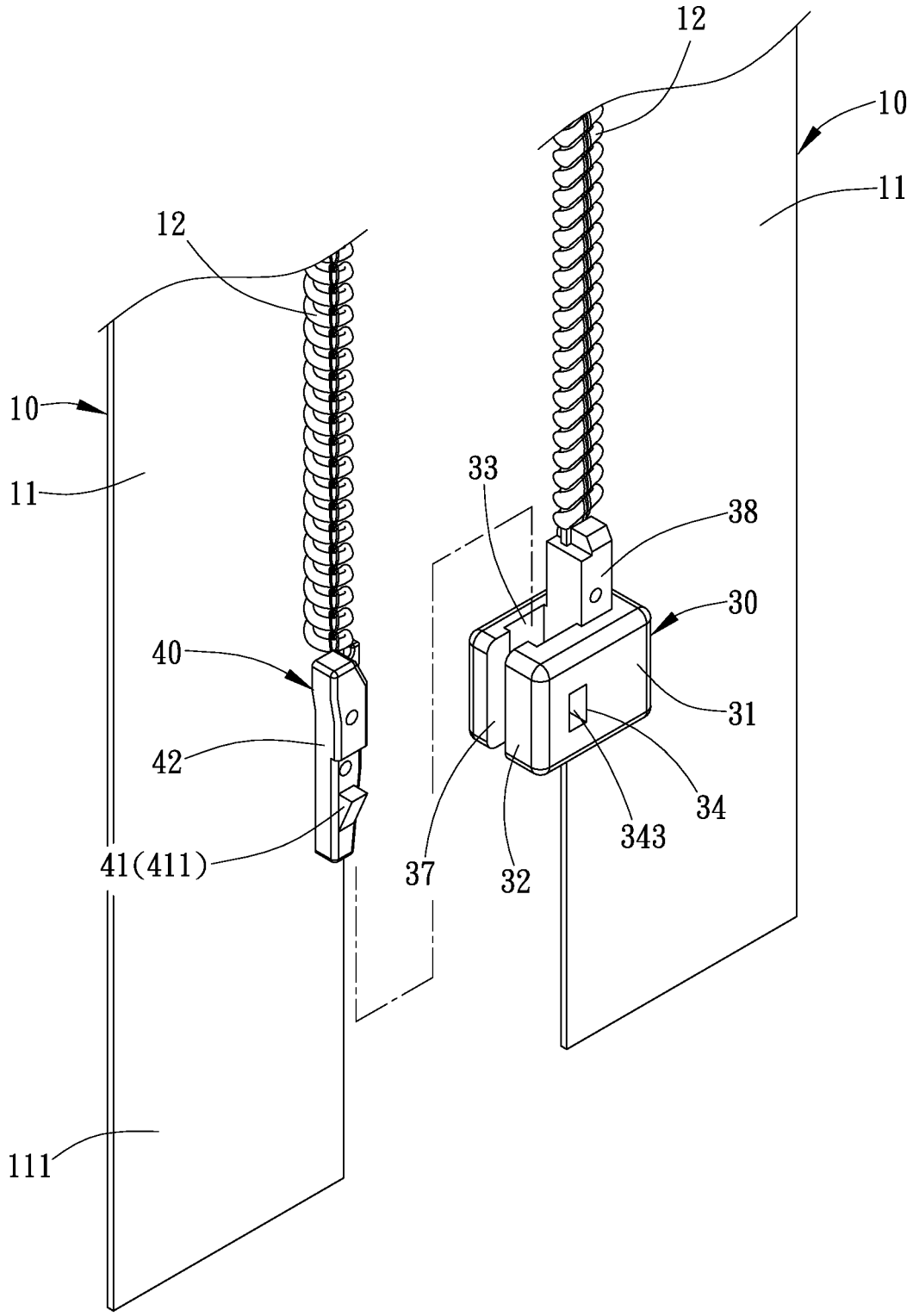
FIG. 9 is an elevational exploded view of the closed end zipper with combined bottom stop in accordance with the fifth embodiment of the present invention.
Figure 10:
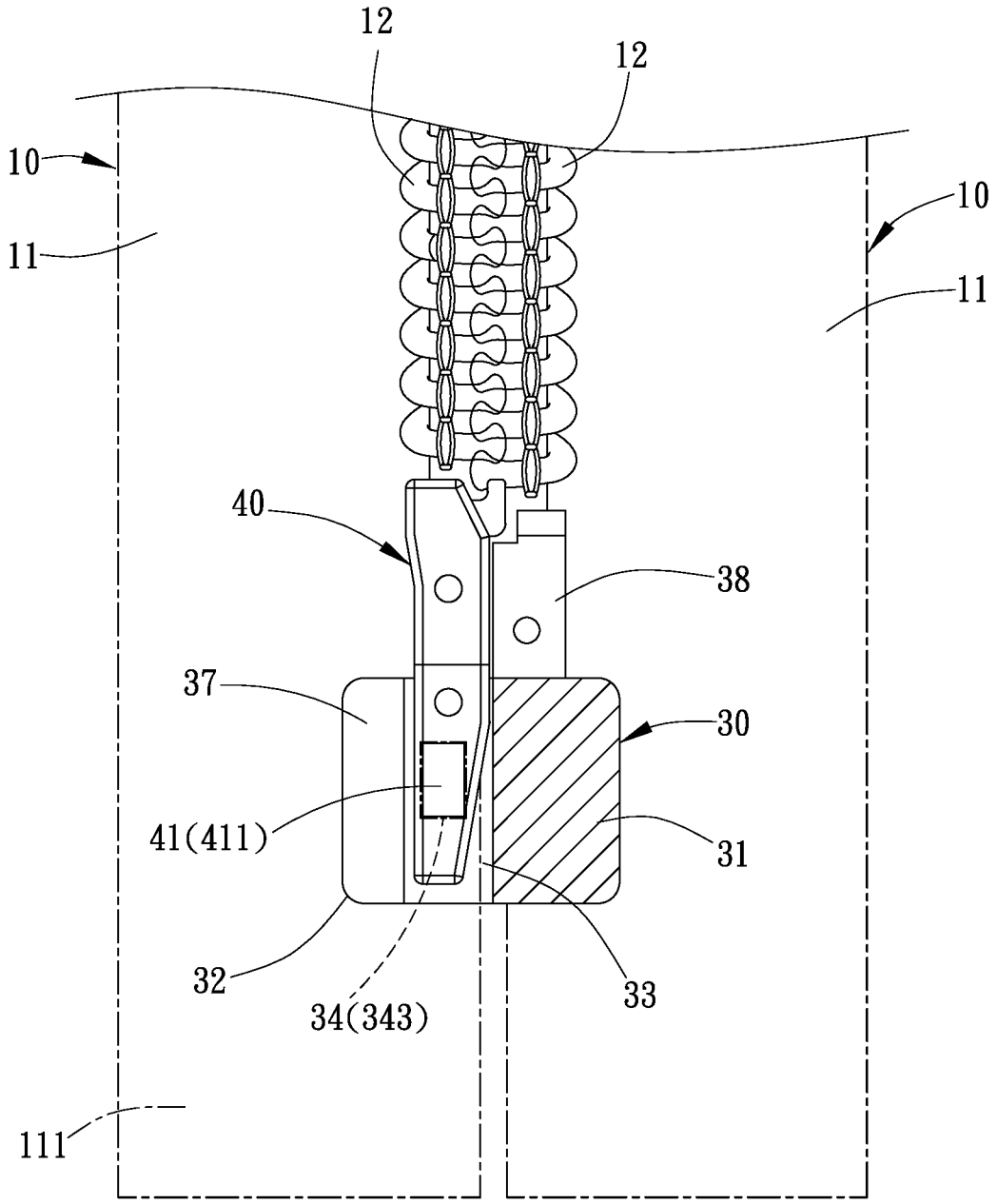
FIG. 10 is a sectional assembly view of a part of the closed end zipper with combined bottom stop in accordance with the fifth embodiment of the present invention.
Figure 11:
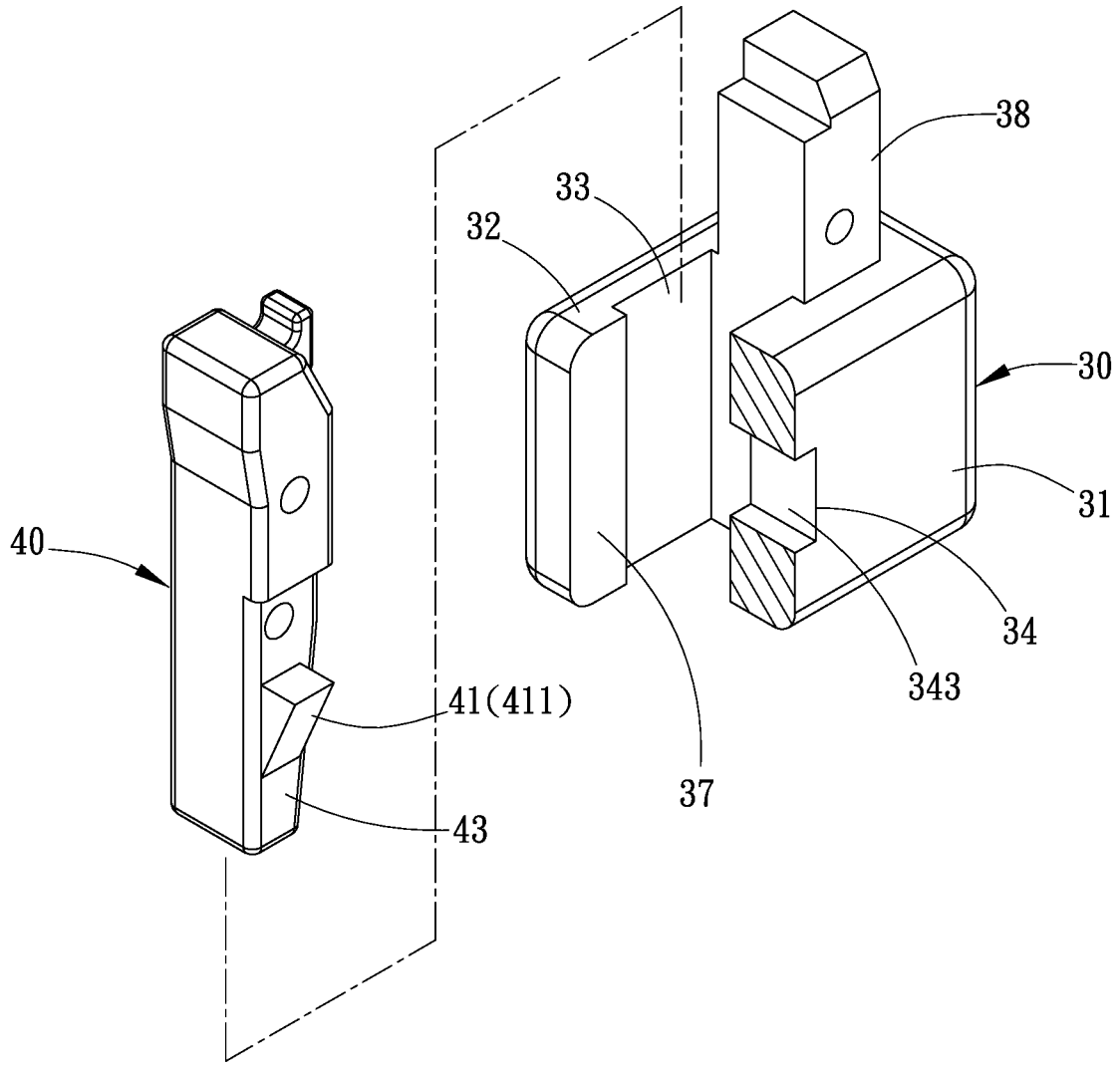
FIG. 11 is an exploded sectional elevational view of a part of the closed end zipper with combined bottom stop in accordance with the fifth embodiment of the present invention.
Figure 12:
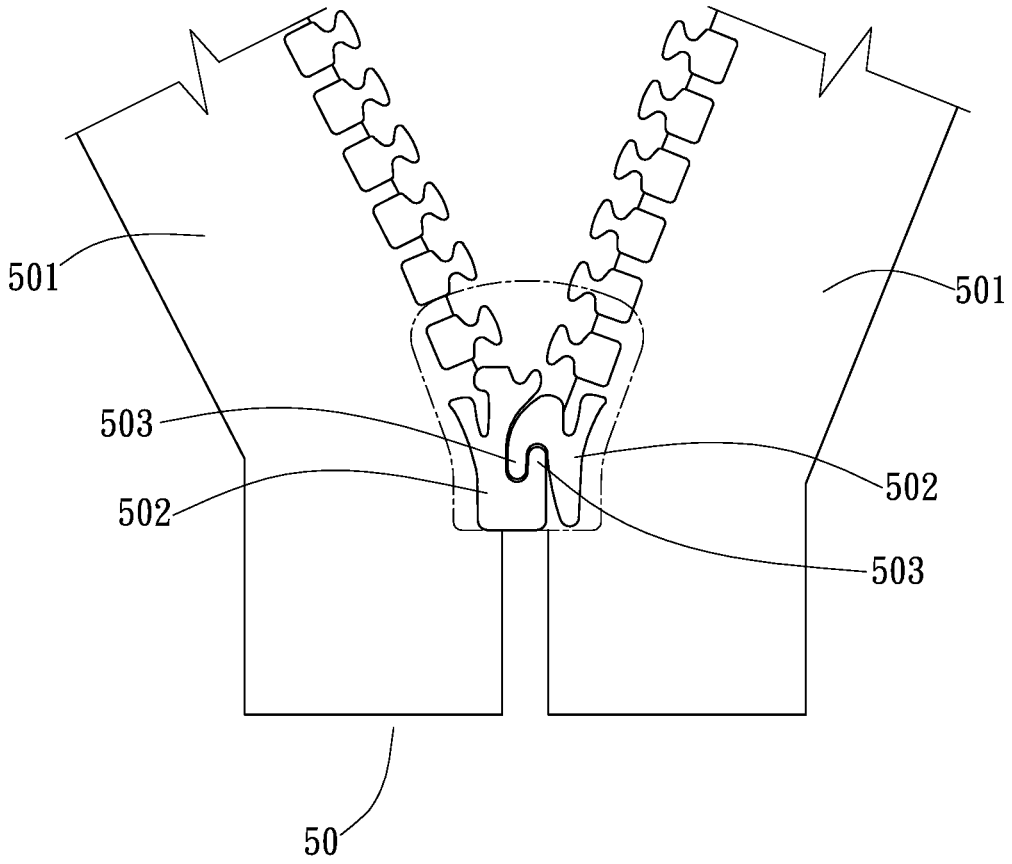
FIG. 12 PRIOR ART
FIG. 12 is a schematic drawing of a closed end zipper with separable bottom stops according to the prior art.

Referring to FIG. 7, in a fourth embodiment of the present invention, the second detent portion 41 is formed on the front surface 43 and lateral surface 42 of the pin 40, and can be implemented in the form of a triangular bump 411 or an oblique protrusion 412; The lateral hole wall 35 and the front hole wall 36 in the pin hole 33 of the bottom stop 30 both implement the first detent portion 34, which can also be implemented as a recess 341 and a blocking surface 342. Similarly, when the pin 40 is inserted into the pin hole 33 of the bottom stop 30, the part of the triangular bump 411 at the front surface 43 is engaged in the recess 341 at the front hole wall 36 and blocked by the blocking surface 342, and the part of the triangular bump 411 at the lateral surface 42 is engaged in the recess 341 at the lateral hole wall 35 and blocked by the blocking surface 342, so that the pin 40 cannot be pulled out in the reverse direction. This kind of engagement structure can achieve a more stable combination.

Referring to FIGS. 1-3 again, in order to enable the pin 40 to be smoothly inserted into the pin hole 33 of the bottom stop 30, and to prevent the cloth tape 11 to which the pin 40 belongs from interfering with the insertion, the lateral surface of pin hole 33 of the bottom stop 30 is implemented with a slot 37. The slot 37 is used to accommodate the cloth tape 11 to which the pin 40 belongs.

Since the ends of the cloth tapes 11 of the two zipper tapes 10 will extend into a respective lower portion 111, the lower portion 111 will hinder the insertion of the pin 40 into the bottom stop 30. Therefore, the inner side of the cloth tape 11 to which the pin 40 belongs is provided with a cutout 13 extending toward the outer side. The cutout 13 is adjacent to the end of the pin 40. When the pin 40 is to be inserted into the pin hole 33, the lower portion 111 can be opened from the cutout 13 to expose the front end of the pin 40 without being blocked by the lower portion 111, allowing the pin 40 to be inserted smoothly into the pin hole 33 of the bottom stop 30 in the above manner.

Referring to FIGS. 8-11, in a fifth embodiment of the present invention, the first detent portion 34 of the bottom stop 30 is implemented as a transverse detent hole 343 and a blocking surface 342. The transverse detent hole 343 extends from the front (or back) of the bottom stop 30 to the pin hole 33. The second detent portion 41 of the pin 40 is also formed on its front surface 43. The second detent portion 41 can also be a triangular bump 411 or the aforementioned oblique protrusion 412. After the pin 40 is inserted into the pin hole 33 of the bottom stop 30, the second detent portion 41 (triangular bump 411 or oblique protrusion 412) is stuck in the transverse detent hole 343. At this time, the transverse detent hole 343 can cause a better latching effect on the second detent portion 41, and the pin 40 can be prevented from detaching from the reverse direction.

In addition, with the fifth embodiment of the present invention, the cutout 13 need not be formed on the side of the cloth tape 11, so that the pin 40 can be smoothly inserted into the pin hole 33 of the bottom stop 30. For the preferred embodiment, refer to FIG. 8 to FIG. 10. The slot 37 of the bottom stop 30 extends directly from the upper end of the bottom stop 30 to the lower end. This enables the lower portion 111 of the cloth tape 11 to pass through the slot 37 first, and then guide the pin 40 to insert into the pin hole 33 of the bottom stop 30. Therefore, through the structure in which the slot 37 extends directly to the lower end of the bottom stop 30, the cutout 13 can be eliminated from the cloth tape 11, and the structural strength of the cloth tape 11 can be maintained.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A closed end zipper, comprising two zipper tapes, each said zipper tape comprising a cloth tape and a row of teeth arranged on an inner side of said cloth tape, and a zipper slider used to link the teeth of said two zipper tapes with each other or to separate the teeth of said two zipper tapes from each other; wherein the cloth tape of one said zipper tape is provided with a bottom stop at an end of the respective said row of teeth and the cloth tape of the other said zipper tape is provided with a pin at a corresponding end of the respective said row of teeth, said bottom stop having one half thereof forming a fixing portion fixedly fastened to the associated said cloth tape and the other half thereof forming a protruding block portion protruding from an inner side of the associated said cloth tape, said protruding block portion comprising a pin hole recessed from a top side thereof and a first detent portion formed in said pin hole, said first detent portion comprising a recess and a blocking surface formed in a hole wall of said pin hole, said pin being used to insert into said pin hole of said bottom stop, said pin comprising a second detent portion corresponding to said first detent portion, said second detent portion being used to engage with said first detent portion when said pin is inserted into said pin hole, so that said recess receives said second detent portion, said blocking surface is abutted against a top surface of said second detent portion, and said pin is prohibited from being separated from said bottom stop after said pin is inserted into said pin hole.

2. The closed end zipper as claimed in claim 1, wherein said second detent portion is a triangular bump protruding from a middle part of said pin.

3. The closed end zipper as claimed in claim 1, wherein said second detent portion is an oblique protrusion protruding from a middle part of said pin.

4. The closed end zipper as claimed in claim 1, wherein said second detent portion is formed on a front surface of said pin; and said first detent portion is formed on a front hole wall of said pin hole.

5. The closed end zipper as claimed in claim 1, wherein said second detent portion is formed on one lateral surface of said pin; and said first detent portion is formed on one lateral hole wall of said pin hole.

6. The closed end zipper as claimed in claim 1, wherein said second detent portion is formed on a front surface and one lateral surface of said pin; and said first detent portion is formed on a front hole wall and one lateral hole wall of said pin hole.

7. The closed end zipper as claimed in claim 1, wherein said pin hole is a rectangular hole; and said pin is a rectangular strip.

8. The closed end zipper as claimed in claim 1, wherein said protruding block portion further comprises a slot cut through a lateral surface of said pin hole for accommodating said cloth tape to which said pin belongs.

9. The closed end zipper as claimed in claim 8, wherein said slot of said bottom stop extends directly from an upper end of said bottom stop to a lower end of said bottom stop.

10. The closed end zipper as claimed in claim 8, wherein the said cloth tape to which said pin belongs comprises a cutout extending toward the outer side and located adjacent to a terminal end of said pin.

11. The closed end zipper as claimed in claim 1, wherein the said cloth tape to which said pin belongs comprises a cutout extending toward the outer side and located adjacent to a terminal end of said pin.

12. A closed end zipper, comprising two zipper tapes, each said zipper tape comprising a cloth tape and a row of teeth arranged on an inner side of said cloth tape, and a zipper slider used to link the teeth of said two zipper tapes with each other or to separate the teeth of said two zipper tapes from each other; wherein the cloth tape of one said zipper tape is provided with a bottom stop at an end of the respective said row of teeth and the cloth tape of the other said zipper tape is provided with a pin at a corresponding end of the respective said row of teeth, said bottom stop having one half thereof forming a fixing portion fixedly fastened to the associated said cloth tape and the other half thereof forming a protruding block portion protruding from an inner side of the associated said cloth tape, said protruding block portion comprising a pin hole recessed from a top side thereof and a first detent portion formed in said pin hole, said first detent portion being a transverse detent hole extending from one of opposing front surface and back surface of said bottom stop to said pin hole, said pin being used to insert into said pin hole of said bottom stop, said pin comprising a second detent portion corresponding to said first detent portion, said second detent portion being used to engage with said first detent portion when said pin is inserted into said pin hole, so that said pin is prohibited from being separated from said bottom stop after said pin is inserted into said pin hole.

13. The closed end zipper as claimed in claim 12, wherein said second detent portion is a triangular bump protruding from a middle part of said pin.

14. The closed end zipper as claimed in claim 12, wherein said second detent portion is an oblique protrusion protruding from a middle part of said pin.

15. The closed end zipper as claimed in claim 12, wherein said second detent portion is formed on a front surface of said pin; and said first detent portion is formed on a front hole wall of said pin hole.

16. The closed end zipper as claimed in claim 12, wherein said second detent portion is formed on a front surface and one lateral surface of said pin; and said first detent portion is formed on a front hole wall and one lateral hole wall of said pin hole.

17. The closed end zipper as claimed in claim 12, wherein said pin hole is a rectangular hole; and said pin is a rectangular strip.

18. The closed end zipper as claimed in claim 12, wherein said protruding block portion further comprises a slot cut through a lateral surface of said pin hole for accommodating said cloth tape to which said pin belongs.

19. The closed end zipper as claimed in claim 18, wherein said slot of said bottom stop extends directly from an upper end of said bottom stop to a lower end of said bottom stop.

20. The closed end zipper as claimed in claim 18, wherein the said cloth tape to which said pin belongs comprises a cutout extending toward the outer side and located adjacent to a terminal end of said pin.

* * * * *